US010337274B2

(12) United States Patent
Xu

(10) Patent No.: US 10,337,274 B2
(45) **Date of Patent: *Jul. 2, 2019**

(54) PLUG RECEPTION ASSEMBLY AND METHOD OF REDUCING RESTRICTION IN A BOREHOLE

(71) Applicant: YingQing Xu, Tomball, TX (US)

(72) Inventor: YingQing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/724,579

(22) Filed: Oct. 4, 2017

(65) Prior Publication Data

US 2018/0023359 A1 Jan. 25, 2018

Related U.S. Application Data

(63) Continuation of application No. 14/016,657, filed on Sep. 3, 2013, now Pat. No. 9,816,339.

(51) Int. Cl.
*E21B 29/02* (2006.01)
*E21B 33/12* (2006.01)

(52) U.S. Cl.
CPC ..... *E21B 29/02* (2013.01); *E21B 33/12* (2013.01)

(58) Field of Classification Search
CPC ..... E21B 29/02; E21B 33/12
See application file for complete search history.

(56) References Cited

U.S. PATENT DOCUMENTS 3,298,440 A 1/1967 Current
3,445,148 A 5/1969 Harris et al.
(Continued)

FOREIGN PATENT DOCUMENTS

EP 1493517 A2 1/2005
WO 2010012184 A1 2/2010
(Continued)

OTHER PUBLICATIONS

Al-Aqeeli, et al. "Development of new Al-based nanocomposites by mechanical alloying", Materials Science and Engineering A 480 (2008) 392-396.

(Continued)

*Primary Examiner* — Michael R Wills, III
(74) *Attorney, Agent, or Firm* — Cantor Colburn LLP

(57) ABSTRACT

A plug reception assembly having one longitudinal end and another longitudinal end includes a mandrel providing a flowpath configured to receive a plug to block flow therethrough; an elastic member forming a portion of a radially exterior surface of the assembly and having one longitudinal end and another longitudinal end; only a single set of slips arranged to maintain the assembly in anchored relation to a borehole, the slips disposed between the one longitudinal end of the assembly and the one longitudinal end of the elastic member, and the assembly being free of slips between the other longitudinal end of the assembly and the other longitudinal end of the elastic member; and at least one component of the assembly being disintegratable or dissolvable by a wave, a target fluid and/or a target temperature to facilitate removal of the assembly as a restriction in the borehole.

19 Claims, 1 Drawing Sheet

(56) References Cited

U.S. PATENT DOCUMENTS 4,368,788 A 1/1983 Drake
4,708,202 A * 11/1987 Sukup ..... E21B 33/1204 166/122
4,901,794 A * 2/1990 Baugh ..... E21B 23/01 166/118
5,709,269 A 1/1998 Head
6,033,622 A 3/2000 Maruyama
6,040,087 A 3/2000 Kawakami
6,220,349 B1 * 4/2001 Vargus ..... E21B 33/1204 166/138
6,354,372 B1 * 3/2002 Carisella ..... E21B 23/01 166/118
6,581,681 B1 * 6/2003 Zimmerman ..... E21B 33/1204 166/135
8,267,177 B1 * 9/2012 Vogel ..... E21B 33/1294 166/131
8,579,023 B1 * 11/2013 Nish ..... E21B 33/128 166/118
9,033,060 B2 * 5/2015 Xu ..... E21B 23/01 166/382
9,080,403 B2 7/2015 Xu et al.
9,284,803 B2 * 3/2016 Stone ..... E21B 23/00
9,309,733 B2 * 4/2016 Xu ..... E21B 23/01
9,366,106 B2 6/2016 Xu et al.
9,682,425 B2 6/2017 Xu et al.
10,016,810 B2 7/2018 Salinas et al.
2004/0244968 A1 12/2004 Cook et al.
2004/0251025 A1 * 12/2004 Giroux ..... E21B 33/134 166/291
2005/0205265 A1 * 9/2005 Todd ..... E21B 23/00 166/376
2005/0205266 A1 * 9/2005 Todd ..... E21B 23/00 166/376
2008/0257549 A1 * 10/2008 Swor ..... E21B 23/06 166/256
2010/0276159 A1 * 11/2010 Mailand ..... E21B 33/129 166/382
2011/0088891 A1 * 4/2011 Stout ..... E21B 33/1204 166/120
2013/0240203 A1 * 9/2013 Frazier ..... E21B 33/129 166/193
2013/0299185 A1 * 11/2013 Xu ..... E21B 43/106 166/376
2013/0300066 A1 * 11/2013 Xu ..... E21B 33/12 277/336
2013/0319668 A1 * 12/2013 Tschetter ..... E21B 43/261 166/281
2014/0110112 A1 * 4/2014 Jordan, Jr. ..... E21B 33/1293 166/281
2014/0311752 A1 * 10/2014 Streich ..... E21B 33/1204 166/376
2016/0279709 A1 9/2016 Xu et al.
2017/0138479 A1 5/2017 Xu et al.
2017/0266923 A1 9/2017 Guest et al.
2018/0178289 A1 6/2018 Xu
2018/0187510 A1 7/2018 Xu et al.

FOREIGN PATENT DOCUMENTS

WO 2014210283 A1 12/2014
WO 2015142862 A1 9/2015

OTHER PUBLICATIONS

European Office Action, European Application No. 10836533.9-1103, dated Jul. 11, 2018, EP Patent Office; EP Office Action 6 pages.
European Office Action, European Application No. 10836539.6-1103, dated Jul. 13, 2018, EP Patent Office; EP Office Action 7 pages.
European Office Action, European Application No. 10836538.8-1103, dated May 15, 2018, EP Patent Office; EP Office Action 9 pages.
European Office Action, European Application No. 10836540.4-1103, dated Jul. 6, 2018; European Patent Office, EP Office Action 8 pages.
Xu et al. "Comparison of sizing small particles using different technologies", Powder Technology 132 (2003) 145-153.

* cited by examiner

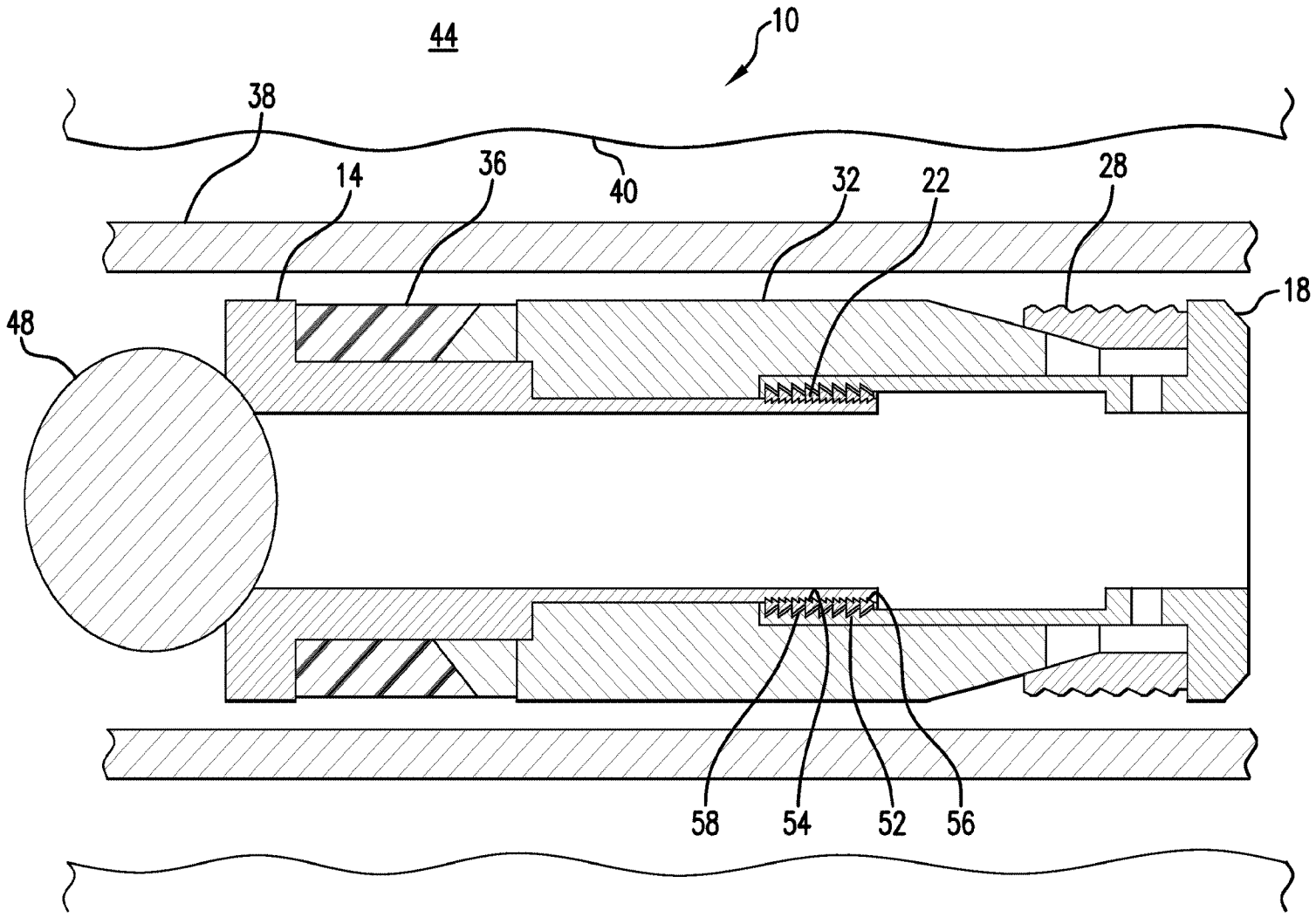
10
44
38
14
36
40
32
22
28
18
48
58
54
52
56

PLUG RECEPTION ASSEMBLY AND METHOD OF REDUCING RESTRICTION IN A BOREHOLE

CROSS REFERENCE TO RELATED APPLICATIONS

This application is a continuation of U.S. application Ser. No. 14/016,657 filed Sep. 3, 2013, the disclosure of which is incorporated by reference herein in its entirety

BACKGROUND

Devices have been available for some time for seatingly receiving a plug within a tubular such as in the downhole hydrocarbon and carbon sequestration industries. These devices necessarily form a restriction within the tubular and typically have features that maintain the devices at fixed positions within the tubular. Though these devices work well for the purpose for which they were designed, the process for removing the restrictions they form, once they are no longer needed, can be costly in both time and money. Removal of such devices from the respective tubular positions can in some cases require running a shifting tool or a cutting tool to the device before it can be disengaged from the tubular. In some cases, this might require an additional dedicated run in the hole with attendant delays and monetary costs. Those who practice in the art will therefore be receptive to devices and methods that overcome the foregoing drawbacks.

BRIEF DESCRIPTION

A plug reception assembly having one longitudinal end and another longitudinal end includes a mandrel providing a flowpath, the mandrel configured to receive a plug to block flow through the flowpath in a downhole direction; an elastic member forming a portion of a radially exterior surface of the plug reception assembly, the elastic member having one longitudinal end and another longitudinal end; only a single set of slips arranged to maintain the plug reception assembly in anchored relation to a borehole, the single set of slips disposed between the one longitudinal end of the plug reception assembly and the one longitudinal end of the elastic member, and the plug reception assembly being free of slips between the other longitudinal end of the plug reception assembly and the other longitudinal end of the elastic member; and at least one component of the plug reception assembly being disintegratable or dissolvable by at least one of a wave, a target fluid and a target temperature, the at least one component being one that upon disintegration or dissolution facilitates removal of the plug reception assembly as a restriction in the borehole.

A method of reducing restriction in a borehole that is configured for a multizone fracturing operation, where the borehole has a plug reception assembly including a mandrel providing a flowpath, the mandrel configured to receive a plug to block flow through the flowpath in a downhole direction; an elastic member forming a portion of a radially exterior surface of the plug reception assembly, the elastic member having one longitudinal end and another longitudinal end; only a single set of slips arranged to maintain the plug reception assembly in anchored relation to a borehole, the single set of slips disposed between the one longitudinal end of the plug reception assembly and the one longitudinal end of the elastic member, and the plug reception assembly being free of slips between the other longitudinal end of the plug reception assembly and the other longitudinal end of the elastic member; and at least one component of the plug reception assembly being disintegratable or dissolvable by at least one of a wave, a target fluid and a target temperature, the at least one component being one that upon disintegration or dissolution facilitates removal of the plug reception assembly as a restriction in the borehole, and the method includes exposing the at least one component in the plug reception assembly to at least one of the wave, target fluid and target temperature to disintegrate or dissolve the at least one component; and facilitating restriction reduction.

BRIEF DESCRIPTION OF THE DRAWINGS

The following descriptions should not be considered limiting in any way. With reference to the accompanying drawings, like elements are numbered alike:

FIG. 1 depicts a cross sectional view of a plug reception assembly disclosed herein.

DETAILED DESCRIPTION

A detailed description of one or more embodiments of the disclosed apparatus and method are presented herein by way of exemplification and not limitation with reference to the FIGS.

Referring to FIG. 1, a plug reception assembly disclosed herein is illustrated at 10. The plug reception assembly 10, shown herein as a frac plug, includes a plurality of components. In this embodiment the components include a mandrel 14, a housing 18, a body lock ring 22, at least one slip 28, a cone 32, and an elastic member 36, illustrated herein as a seal. One or more of the components 14, 18, 22, 28, 32 and 36 and subsets thereof are assemblable together to form the plug reception assembly 10.

The plug reception assembly 10 is positionally fixable within a liner or casing 38, or other tubular, or open borehole 40 in an earth formation 44 and is seatingly receptive to a plug 48 run thereagainst. The plug reception assembly 10, when plugged with one of the plugs 48 can allow pressure to build thereagainst to do work such as fracing or treating the earth formation 44, or actuating a tool (not shown). A plurality of the plug reception assemblies 10 can be distributed over a length of the borehole 40 so that a plurality of the plugs 48 can be run to sequentially sealingly engage with each of the plug reception assemblies 10. Such a system can be used in a multizone fracturing operation. The plurality of plug reception assemblies 10 can be configured, sized and positioned within the borehole 40 to be seatingly engagable with a plurality of the plugs 48. For example, a smallest of the plugs 48 may be run and engaged with the furthest plug reception assembly 10 while each additional one of the plugs 48 is larger in dimension and engages with the next plug reception assembly 10 positioned adjacently upstream of the previous plug reception assembly 10.

At least one of the components 14, 18, 22, 28, 32, 36 is configured to disintegrate upon being exposed to a selected condition. The selected condition can be a naturally occurring or a created environment. The foregoing allows an operator to remove one or more of the components 14, 18, 22, 28, 32, 36 to thereby facilitate removal of restrictions within the borehole 40 caused by the presence of the plug reception assemblies 10 positioned therewithin. In so doing, the operator can remove the plug reception assemblies 10 after they have served the purpose for which they were employed, without having to run a drill or mill into the borehole 40 to mechanically remove them.

A plurality of the components 14, 18, 22, 28, 32, 36 can be configured to disintegrate in the same target environment. Such an environment can include energy waves such as acoustic waves that can break the components 14, 18, 22, 28, 32, 36 into small pieces, thereby effectively removing the plug reception assembly 10 constructed therefrom. Alternate embodiments of the plug reception assembly 10 can have the components 14, 18, 22, 28, 32, 36 made of metals and metal alloys that are configured to dissolve upon exposure to specific fluids, temperatures and pressures, for example. In some embodiments some of the components 14, 18, 22, 28 and 32 may be rigid members while others, such as the seal 36 can be a non-rigid member such as an elastomer, for example. The fluids can include fluids anticipated to be encountered in a downhole environment such as oil, water, brine and combinations of the foregoing or fluids that are applied to the environment having at least a purpose of dissolving the components 14, 18, 22, 28, 32, 36. As such, for applications wherein the plug reception assembly 10 is employed in the borehole 40 such as during a hydrocarbon recovery or a carbon dioxide sequestration operation, for example, the dissolution of the components 14, 18, 22, 28, 32, 36 can be initiated by entry into the borehole 40. Alternately, dissolution can be initiated after exposing the plug reception assembly 10 to a selected fluid that is pumped to the location of the plug reception assembly 10. Fluids such as acids and bases that may not occur naturally in the borehole 40 can allow additional control over timing of dissolution since the dissolution would not begin until the selected fluid is introduced to the location of the plug reception assembly 10. Relying on pumping the selected fluid before disintegration occurs provides additional control since a subset of a whole set of the plug reception assemblies 10 can be selectively exposed to the selected fluid at a desired time.

Both the mandrel 14 and the housing 18 are in operable engagement with the body lock ring 22. The operable engagement being through a ratcheting arrangement. The body lock ring 22 has radially outward facing teeth 52 that engage with radially inwardly facing teeth 54 on the housing 18. The body lock ring 22 also has radially inwardly facing teeth 56 that engage with radially outwardly facing teeth 58 on the mandrel 14. The body lock ring 22 is C shaped due to a longitudinal opening (not visible in the FIGURE) that extends longitudinally through the body lock ring 22. This allows the body lock ring 22 to flex which action changes a radial size of the body lock ring 22 to thereby allow the teeth 56 thereon to ratchet relative to the teeth 58 when the mandrel 14 is pushed longitudinally toward the housing 18. This ratcheting engagement, while allowing longitudinal movement of the mandrel 14 towards the housing 18 prevents movement of the mandrel 14 in a longitudinal direction away from the housing 18 thereby discouraging unsetting of the plug reception assembly 10 from its position within the borehole 40. Disintegration of one more of the mandrel 14, the housing 18 and the body lock ring 22 can defeat the ratcheting engagement of the teeth 52, 54, 56, 58.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A plug reception assembly having one longitudinal end and another longitudinal end, the plug reception assembly comprising:

a mandrel providing a flowpath, the mandrel configured to receive a plug to block flow through the flowpath in a downhole direction;

an elastic member forming a portion of a radially exterior surface of the plug reception assembly, the elastic member having one longitudinal end and another longitudinal end;

only a single set of slips arranged to maintain the plug reception assembly in anchored relation to a borehole, the single set of slips disposed between the one longitudinal end of the plug reception assembly and the one longitudinal end of the elastic member, and the plug reception assembly being free of slips between the other longitudinal end of the plug reception assembly and the other longitudinal end of the elastic member; and at least one component of the plug reception assembly configured to disintegrate upon exposure to a wave, the at least one component being one that upon disintegration facilitates removal of the plug reception assembly as a restriction in the borehole.

2. A plug reception assembly having one longitudinal end and another longitudinal end, the plug reception assembly comprising:

a mandrel providing a flowpath, the mandrel configured to receive a plug to block flow through the flowpath in a downhole direction;

an elastic member forming a portion of a radially exterior surface of the plug reception assembly, the elastic member having one longitudinal end and another longitudinal end;

only a single set of slips arranged to maintain the plug reception assembly in anchored relation to a borehole, the single set of slips disposed between the one longitudinal end of the plug reception assembly and the one longitudinal end of the elastic member, and the plug reception assembly being free of slips between the other longitudinal end of the plug reception assembly and the other longitudinal end of the elastic member; and at least one component of the plug reception assembly being disintegratable or dissolvable by at least one of a wave, a target fluid and a target temperature, the at least one component being one that upon disintegration or dissolution facilitates removal of the plug reception assembly as a restriction in the borehole;

wherein the plug to block flow through the flowpath in a downhole direction is a first plug having a first size, and the flowpath extends from a first end to a second end of the plug reception assembly, the flowpath configured to enable passage of a second plug from a location uphole of the plug reception assembly to a location downhole of the plug reception assembly, the second plug having a second size smaller than the first size.

3. The plug reception assembly of claim 2, wherein the at least one component is configured to disintegrate upon exposure to the target temperature.

4. The plug reception assembly of claim 2, wherein the at least one component is configured to dissolve upon exposure to the target fluid, the target fluid naturally occurring within the borehole in an earth formation or introduced into the borehole.

5. The plug reception assembly of claim 2, wherein the at least one component is a metal alloy.

6. The plug reception assembly of claim 2, wherein the at least one component is a plurality of rigid components configured to maintain the plug reception assembly in sealed relation to the borehole.

7. The plug reception assembly of claim 2, wherein the plug reception assembly is a frac plug.

8. The plug reception assembly of claim 2, further comprising only a single slip-actuating cone for actuating the single set of slips, the single slip-actuating cone longitudinally disposed between the single set of slips and the one longitudinal end of the elastic member.

9. The plug reception assembly of claim 2, wherein the one longitudinal end of the plug reception assembly is a downhole end of the plug reception assembly, and the one longitudinal end of the elastic member is a downhole end of the elastic member.

10. The plug reception assembly of claim 2, wherein a longitudinal length between the one end of the elastic member and the one end of the plug reception assembly is greater than a longitudinal length between the other end of the elastic member and the other end of the plug reception assembly.

11. A plug reception assembly having one longitudinal end and another longitudinal end, the plug reception assembly comprising:

a mandrel providing a flowpath, the mandrel configured to receive a plug to block flow through the flowpath in a downhole direction;

an elastic member forming a portion of a radially exterior surface of the plug reception assembly, the elastic member having one longitudinal end and another longitudinal end;

only a single set of slips arranged to maintain the plug reception assembly in anchored relation to a borehole, the single set of slips disposed between the one longitudinal end of the plug reception assembly and the one longitudinal end of the elastic member, and the plug reception assembly being free of slips between the other longitudinal end of the plug reception assembly and the other longitudinal end of the elastic member;

at least one component of the plug reception assembly being disintegratable or dissolvable by at least one of a wave, a target fluid and a target temperature, the at least one component being one that upon disintegration or dissolution facilitates removal of the plug reception assembly as a restriction in the borehole; and a housing, the housing additionally providing the flow path, the housing and the mandrel extending along a radially interior surface of the plug reception assembly, wherein longitudinal movement of the mandrel relative to the housing reduces a longitudinal length of the plug reception assembly from the one end of the plug reception assembly to the other end of the plug reception assembly.

12. The plug reception assembly of claim 11, further comprising a ratcheting arrangement between the mandrel and the housing.

13. The plug reception assembly of claim 11, wherein the elastic member is disposed on the mandrel and positioned radially outwardly of at least a portion of the mandrel, and the single set of slips is supported at least partially by the housing and disposed radially outwardly of at least a portion of the housing.

14. The plug reception assembly of claim 13, further comprising a cone disposed between the elastic member and the single set of slips, wherein the cone is disposed on both the mandrel and the housing, and disposed radially outwardly of at least portions of both the mandrel and the housing.

15. A method of reducing restriction in a borehole that is configured for a multizone fracturing operation, the borehole having the plug reception assembly of claim 2, the method comprising:

exposing the at least one component in the plug reception assembly to at least one of the wave, target fluid and target temperature to disintegrate or dissolve the at least one component; and facilitating restriction reduction.

16. The method of claim 15, including exposing the at least one component to the target fluid within which the at least one component is configured to dissolve.

17. The method of claim 15, including exposing the at least one component to the temperature to dissolve the at least one component.

18. The method of claim 15, further comprising disintegrating substantially all rigid components within the plug reception assembly.

19. A method of reducing restriction in a borehole that is configured for a multizone fracturing operation, the borehole having the plug reception assembly of claim 2, the method comprising:

exposing the at least one component in the plug reception assembly to the wave within which the at least one component is configured to disintegrate; and facilitating restriction reduction.

* * * * *